US011702828B2

(12) United States Patent
Song et al.

(10) Patent No.: US 11,702,828 B2
(45) Date of Patent: Jul. 18, 2023

(54) SELF-CLEANING SINK

(71) Applicant: AS America, Inc., Piscataway, NJ (US)

(72) Inventors: Ki Bok Song, Plainview, NY (US); Alison J. Lyons, Jersey City, NJ (US); Jiekun Qian, Astoria, NY (US); Jean-Jacques L'Henaff, New Canaan, CT (US); Emilie Williams, New York, NY (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 17/718,483

(22) Filed: Apr. 12, 2022

(65) Prior Publication Data

US 2022/0235538 A1 Jul. 28, 2022

Related U.S. Application Data

(63) Continuation of application No. 16/770,130, filed as application No. PCT/US2018/063988 on Dec. 5, 2018, now Pat. No. 11,332,915.

(60) Provisional application No. 62/595,879, filed on Dec. 7, 2017.

(51) Int. Cl.

| | |
|---|---|
| ***E03C 1/182*** | (2006.01) |
| ***E03C 1/186*** | (2019.01) |
| ***E03C 1/048*** | (2006.01) |
| ***E03C 1/264*** | (2006.01) |

(52) U.S. Cl.

CPC ..... *E03C 1/182* (2013.01); *E03C 1/186* (2013.01); *E03C 1/048* (2013.01); *E03C 1/264* (2013.01); *E03C 2201/40* (2013.01)

(58) Field of Classification Search

CPC ..... E03C 1/182; E03C 1/186; E03C 1/048; E03C 1/264; E03C 2201/40; A47L 15/0086

USPC ..... 4/638

See application file for complete search history.

(56) References Cited

U.S. PATENT DOCUMENTS

| | | | | |
|---|---|---|---|---|
| 726,016 | A * | 4/1903 | Blanchard | A47L 15/241 134/91 |
| 863,825 | A * | 8/1907 | Acker | E03C 1/18 4/642 |
| 1,426,046 | A * | 8/1922 | Cohen | E03C 1/048 4/584 |
| 1,677,160 | A * | 7/1928 | Woolfenden | A47K 3/20 4/568 |
| 11,149,420 | B1 * | 10/2021 | Grant | E03C 1/14 |

(Continued)

*Primary Examiner* — Benjamin R Shaw

(74) *Attorney, Agent, or Firm* — Tyler A. Stevenson; Anna-lisa L. Gallo

(57) ABSTRACT

Systems, methods, and techniques for cleaning sinks and dishes are provided. In some embodiments, a cleaning system comprises at least one fluid supply, at least one opening in a side wall of a sink basin, and at least one nozzle positioned along an exterior of the sink basin. The nozzle is configured to receive fluid from the fluid supply, and dispense fluid through an opening in a side wall of the sink basin to an interior surface of the sink basin. In some embodiments, the nozzle is configured to dispense fluid to the interior of a sink basin, such that substantially all surfaces of the interior of the sink basin are covered with a thin layer of fluid. In some embodiments, nozzle dispensing angle, duration of a cleaning cycle, flow rate or amount of dispensing fluid, or activation of a cleaning cycle may be manually or automatically controlled.

20 Claims, 3 Drawing Sheets

(56) References Cited

U.S. PATENT DOCUMENTS

| | | | | |
|---|---|---|---|---|
| 2003/0205246 | A1* | 11/2003 | Christman | A47L 15/4219 134/115 R |
| 2003/0205248 | A1* | 11/2003 | Christman | A47L 15/508 134/115 R |
| 2003/0205250 | A1* | 11/2003 | DeBoer | H01H 13/807 134/115 R |
| 2003/0205252 | A1* | 11/2003 | DeBoer | A47L 15/0086 134/201 |
| 2003/0205255 | A1* | 11/2003 | DeBoer | A47L 15/4209 134/115 R |
| 2007/0011806 | A1* | 1/2007 | Knowlton | E03C 1/048 4/619 |
| 2007/0056092 | A1* | 3/2007 | Prather | E03C 1/18 4/619 |
| 2007/0061960 | A1* | 3/2007 | Sha | E03C 1/048 4/619 |
| 2007/0118986 | A1* | 5/2007 | Osburn | E03C 1/048 4/675 |
| 2007/0124857 | A1* | 6/2007 | Milne | E03C 1/0404 4/675 |
| 2007/0174958 | A1* | 8/2007 | McKay | E03C 1/182 4/619 |
| 2015/0376881 | A1* | 12/2015 | Moe | A47K 10/48 4/638 |
| 2016/0069054 | A1* | 3/2016 | Yu | E03C 1/046 4/638 |
| 2016/0230374 | A1* | 8/2016 | Just | E03C 1/18 |
| 2016/0289933 | A1* | 10/2016 | Williams, III | E03C 1/18 |
| 2018/0100297 | A1* | 4/2018 | Boland | E03C 1/181 |
| 2018/0206632 | A1* | 7/2018 | Shin | A47B 77/08 |
| 2019/0133406 | A1* | 5/2019 | Alali | A47L 15/0086 |
| 2020/0362547 | A1* | 11/2020 | Glivar | E03C 1/182 |

* cited by examiner

SELF-CLEANING SINK

BACKGROUND

Sinks are typically cleaned on a regular basis to prevent the buildup of dirt and other contaminants, soap residue, stains, and water-marks. Kitchen sinks in particular should be cleaned regularly to minimize germs, bacteria, and other unsafe contaminants that can cause illness. Specifically, kitchen sinks often need to be thoroughly sanitized after handling certain foods (raw meat, shellfish, etc.) to prevent the spread of dangerous bacteria such as salmonella and *E. coli*.

Currently, sinks are typically cleaned manually. The process of manually cleaning a sink typically involves a user manually applying a cleaning solution to the surface of a sink basin, leaning over to manually scrub the cleaning solution into the surface of the sink basin, and manually rinsing away the cleaning solution and any loosened debris. Depending on the type of contaminant and the duration of time since the last cleaning, a manual sink-cleaning process can be a very time-consuming and labor-intensive process.

Additionally, reusable dishes should be cleaned after each use to remove leftover food, residue, and germs. Typically, the process of cleaning dirty dishes is completed either manually in a kitchen sink or automatically with a dishwasher. A manual dish-cleaning process involves manually applying a cleaning solution or detergent to a surface of the dish, manually scrubbing the dish to remove germs, food, and other residue, manually rinsing the dish to remove loosened debris and detergent, and manually drying the dish. Further, a deeply soiled or stained dish must be pre-treated before the manual cleaning process to loosen or soften hardened food and other residue.

An automatic dishwasher process is generally less labor-intensive than a manual dish-cleaning process, but a dishwasher alone generally does not have the ability to remove all dried, hardened food residue from various types of surfaces and materials. Accordingly, dirty dishes often need to undergo a pre-cleaning process prior to an automatic dishwashing process completed by a dishwasher. For instance, deeply soiled dishes must be manually scrubbed and rinsed prior to being cleaned by a dishwasher. Some dirty dishes may need to be rinsed of any food residue prior to being cleaned by a dishwasher. Thus, even an automatic dishwashing process includes a manual dish-cleaning or dish-rinsing component.

SUMMARY

As discussed above, the most common solution to the need to clean a sink is for a user to manually clean the sink by hand. This solution can be tiresome, time-consuming, ineffective and unsanitary. Manual sink-cleaning exposes users to potentially harsh chemicals, germs, and bacteria during the cleaning process.

Additionally, the most common solutions to the need to clean dirty dishes are for a user to manually clean the dishes by hand or to automatically clean the dishes by using a dishwasher. However, even an automatic dish-cleaning process by using a dishwasher often requires a manual pre-cleaning or pre-rinsing process to loosen and remove some food and debris on the dish. Further, both a manual and an automatic dish-cleaning system can expose users to potentially harmful chemicals, germs, and bacteria, and can be cumbersome or even dangerous by requiring users to work in a sink basin that may contain sharp knives or broken, sharp-edged dishes.

Accordingly, there is a need for improved systems, methods, and techniques for cleaning sinks and dishes. Particularly, there is a need for systems, methods, and techniques for cleaning sinks and dishes that reduce or eliminate the time-consuming and labor-intensive manual sink-cleaning process, manual dish-cleaning process, and the pre-cleaning or pre-rinsing process of the automatic dish-cleaning process. Further, there is a need for systems, methods, and techniques for cleaning sinks and dishes that protect users from harsh chemicals, germs, and bacteria and need to work in a cluttered and dangerous sink basin during each of the above-described cleaning processes.

Sink-cleaning systems and dish-cleaning systems that may address the above needs are provided herein. The cleaning system may include one or more nozzles that dispense water, cleaning solution, and/or steam into the sink basin for cleaning. A sink-cleaning system can perform various cleaning and rinsing cycles. For example, a sink-cleaning system may perform a cleaning cycle, wherein a cleaning solution is dispensed onto an interior surface of a sink basin, followed by a rinsing cycle, wherein water is dispensed onto an interior surface of the sink basin. A sink-cleaning system may also perform a steam-cleaning cycle, wherein steam is dispensed onto an interior surface of a sink basin.

The cleaning system may be activated by user input. A cleaning system may be automatically controlled by a computerized system such that a cycle may be started by a user input (e.g., turning a knob, pressing a button, entering a command to a computer interface, etc.) and may last for a predetermined period of time. For example, a user may activate an initial cleaning cycle, wait for the initial cleaning cycle to complete, and then the user may activate a rinsing cycle. For dish-cleaning, a user may activate a rinsing cycle, wait for the rinsing cycle to complete, and then the user may activate a drying cycle.

The cleaning system may activate automatically. The cleaning system may activate an initial cleaning cycle upon detecting that the sink is not in use. For example, a cleaning system may determine that the sink is not in use by detecting that a lid is secured over the top of the sink basin, fully enclosing the sink basin. The sink-cleaning system may automatically activate a cleaning cycle based on the detection of the lid, whereby cleaning solution is dispensed onto an interior surface of the sink basin and allowed to sit and react for a predetermined amount of time. Upon the completed duration of the predetermined amount of time, the cleaning system may then activate a rinsing cycle, whereby water is dispensed onto an interior surface of the sink basin to wash away cleaning solution and loosened debris from the cleaning cycle. Further, the cleaning system may activate a steam-cleaning cycle upon detecting that the sink is not in use.

The dish-cleaning system may also activate automatically. The system may activate a rinsing cycle upon detecting motion or detecting the presence of an object. For example, a user may position a dish within range of a motion sensor or presence sensor. The motion sensor may send a control signal to the dish-cleaning system to activate a rinsing cycle. The dish-cleaning system may automatically activate a drying cycle after the completion of a rinsing cycle. In some embodiments, a steam-cleaning cycle may activate automatically upon detecting that the sink is not in use. For example, the system may determine that the sink is not in use by detecting that a lid is secured over the top of the sink, fully enclosing the sink. By detecting the presence of a lid, the dish-cleaning system may activate a steam-cleaning cycle.

Systems, methods, and techniques described herein may be advantageous because they may avow a user to be able to keep a sink cleaner for longer than by using manual cleaning processes, may enable removal of soap scum and residue (food, make-up, etc.) from sinks, may enable disinfection of sinks, and may enable prevention and removal of water spots and other stains from sinks.

Additionally, systems, methods, and techniques described herein may be advantageous because they may allow a user to alleviate some of the time-consuming and labor-intensive aspects of manually cleaning and manually pre-cleaning and pre-rinsing dirty dishes, and may minimize the potential for injuries related to manual dish-cleaning.

These and other features, aspects, and advantages of the disclosure will be apparent from a reading of the following detailed description together with the accompanying drawings, which are briefly described below. The invention includes any combination of two, three, four, or more of the disclosed embodiments as well as combinations of any two, three, four, or more features or elements set forth in this disclosure, regardless of whether such features or elements are expressly combined in a specific embodiment description herein. This disclosure is intended to be read such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1:
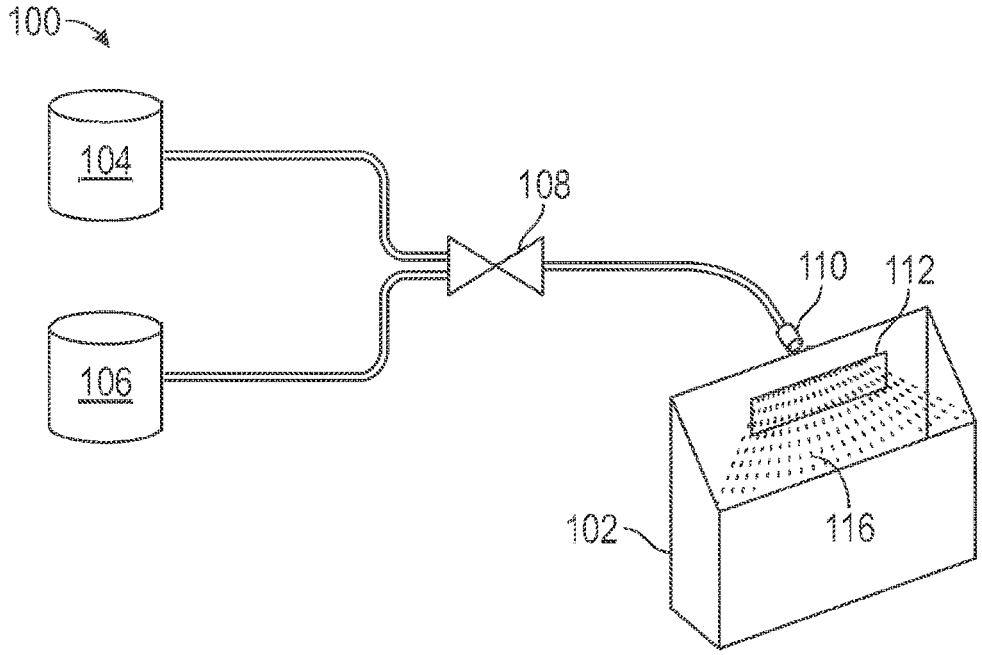
FIG. 1 shows a sink-cleaning system in accordance with some embodiments.

Described herein are exemplary embodiments of cleaning systems that may address the problems and shortcomings of known sink-cleaning, dish-rinsing, and dish-drying methods and systems described above, including the problems of tiresome and burdensome manual labor and possible injury. As used herein, the term "cleaning system" may refer to any cleaning, steam-cleaning, rinsing, and/or drying system including sink-cleaning systems, dish-rinsing systems, and/or dish-drying systems. The term "cleaning cycle" may refer to any cleaning, steam-cleaning, rinsing, and/or drying process according to the embodiments described herein. Further, the terms "fluid" and "cleaning fluid" may refer to any detergent, cleaning solution or chemical, water, steam, and/or gas according to the embodiments described herein.

The cleaning systems described herein may address the problems discussed above by using nozzles to dispense fluid onto an interior surface of a sink basin. Nozzles can be placed just outside the sink basin wall towards a top of the sink basin or alternately may be integrally formed as part of the sink basin wall. The sink-cleaning system can be configured such that fluid is dispensed from the nozzles, through an opening in the sink basin wall, and onto an interior surface of the sink basin. By placing the nozzles along an upper edge of the sink basin and dispensing the fluid substantially horizontally across the sink basin, substantially horizontally from an upper location of one side of the sink basin to an upper location of another side of the sink basin, the fluid can flow down the sides of the sink basin wall and onto the floor of the sink basin.

The cleaning system may perform one or more cycles throughout a complete cleaning process. For example, a sink-cleaning system may perform a cleaning cycle using cleaning solution, a steam-cleaning solution using steam, and a rinsing solution using water. A dish rinsing and drying system may perform a water-only rinsing cycle and air-only drying cycle. Further, various types and durations of cleaning processes can be performed such as a quick-clean cycle and a deep-clean cycle.

One or more valves may be used to control the flow of the fluid from a supply source to the one or more sink-cleaning nozzles. A cleaning solution supply may be configured such that it automatically mixes with the water downstream of a valve, causing a cleaning solution and water mixture to flow to a cleaning nozzle of the sink-cleaning system. Alternatively, the cleaning solution and water may be dispensed by different nozzles of the sink-cleaning system. Some embodiments may include multiple valves to control the flow of the cleaning solution and water individually.

Some embodiments may incorporate the use of lid during a cleaning process. For example, a lid may be used during a steam-cleaning cycle to enclose the sink basin and retain the steam in the sink basin. Thus, the lid may help keep the steam in the sink throughout the duration of the steam-cleaning cycle. In some embodiments, the sink-cleaning system may detect the presence of a lid without user input. In some embodiments, the sink-cleaning system will prevent activation of a cleaning cycle without the presence of a lid.

Various embodiments of cleaning systems, including both sink-cleaning and dish-cleaning systems, are described below in detail with reference to the figures included herein.

FIG. 1 shows a cleaning system in accordance with some embodiments. Namely, FIG. 1 shows a diagram of components of a sink-cleaning system 100.

In some embodiments, sink-cleaning system 100 comprises sink 102. Nozzle 110 may be positioned outside, behind, flush with, and/or in front of a basin of sink 102. In some embodiments, cleaning fluid 116 may be directed from the nozzle, through opening 112, and to an interior surface of the basin of sink 102. In some embodiments, cleaning fluid 116 may be directed from the nozzle directly to an interior surface of the basin of sink 102, without passing through opening 112. Fluid dispensed by the nozzle 110 is supplied from water supply 106 and/or cleaning solution supply 104. A valve 108 may control the flow of water supply 106 and/or cleaning solution supply 104.

Sink 102 may comprise any basin, such as a kitchen sink, bathroom sink, or utility sink. Sink 102 may comprise more than one basin. The basin of sink 102 may comprise four discrete walls, as shown in FIG. 1, or it may be a round, bowl shape. A surface of the basin of sink 102 may be made of stainless steel, ceramic, composite material, cast iron, clay, or other metals or minerals.

In some embodiments, nozzle 110 may be positioned at an angle such that it dispenses fluid from nozzle 110, through opening 112 of the sink basin, to an interior of the sink basin. For example, nozzle 110 may dispense water, cleaning solution, and/or steam through opening 112 in the sink wall or sink basin of sink 102. The nozzle 110 may be configured such that fluid 116 is dispensed from nozzle 110 and travels in an substantially horizontal direction across sink 102, from an upper location of a side of the sink basin (opening 112), to an upper location of another side of the sink basin of sink 102. Fluid 116 may be dispensed across the top of the sink 102 such that gravity may pull fluid 116 down along the interior side surfaces of the sink and onto the floor of the sink basin of sink 102.

In some embodiments, nozzle 110 may be configured such that it directs a flow of fluid 116 to a drain in a floor of the sink basin. For example, some modern sink basins are designed to include four walls and a flat bottom surface with a drain in the center of the flat bottom surface. However, a flat bottom surface does not encourage fluid flow to the center drain, and thus can cause food particles and even water to sit in the corners of the flat bottom of the sink basin. Accordingly, nozzle 110 may be configured to dispense fluid 116 such that the dispensed fluid naturally flows to a drain in the floor of the sink basin.

Nozzle 110 may comprise numerous configurations. In some embodiments, nozzle 110 may comprise a single nozzle controlling a single stream of fluid 116, or it may comprise more than one nozzle controlling more than one stream of fluid 116. In some embodiments, nozzle 110 may dispense a single type of fluid 116, or nozzle 110 may dispense multiple types of fluid 116. In some embodiments, nozzle 110 may comprise a single nozzle configured to dispense numerous streams of cleaning fluid 116. For example, FIG. 1 shows a single nozzle 110 dispensing four discrete streams of cleaning fluid 116.

Further, nozzle 110 may be positioned in various locations relative to a sink basin of sink 102. For example, FIG. 1 shows nozzle 110 located at the back of the sink basin, configured to dispense cleaning fluid 116 toward a front interior surface of the sink basin. However, a cleaning system may comprise several nozzles 110 located at various locations along the perimeter of the sink basin and configured to dispense cleaning fluid 116 toward an opposing interior surface of the sink basin, based on the location of the particular nozzle dispensing a given stream of cleaning fluid. In some embodiments, nozzles 110 may be configured to dispense fluid 116 towards a drain (not shown) located in a floor of the sink basin of sink 102. Nozzles 110 may also be located at the front of the sink basin and be configured to dispense fluid towards a back interior surface of the sink basin. In some embodiments, nozzle 110 may be configured to dispense fluid 116 down a side of the sink basin of sink 102 such that a stream of cleaning fluid 116 is dispensed from nozzle 110 onto an interior surface of the sink basin proximately located to nozzle 110. Cleaning fluid 116 may then flow down an interior surface and to a floor of the sink basin of sink 102.

Further, the position of nozzle 110 may be changed. For example, depending on the type of cleaning process desired by the user, the angle at which the nozzle 110 is positioned may be customized. In some embodiments, the position of nozzle 110 may be manually changed. In some embodiments, the position of nozzle 110 may be automatically changed. For example, a user may program into a computerized system preferences according to various cleaning cycles, including a dispensing angle of nozzle 110. When a specific cleaning cycle is activated, nozzle 110 may automatically change in preparation for the specified cleaning cycle, according to the predetermined dispensing angle programmed by the user.

In some embodiments, nozzle 110 can dispense one or more of a cleaning solution, water, or steam. In cases in which only a single nozzle is used, all materials used in the cleaning process may be dispensed from a single nozzle (cleaning solution, water, and/or steam). Accordingly, a single valve may control the supply for each cleaning material based on the type of cleaning or rinsing cycle activated at any given time. In some embodiments, a cleaning cycle may comprise dispensing cleaning solution only. Valve 108 may be configured to block flow from water supply 106 and only permit cleaning solution to flow to nozzle 110. In some embodiments, a cleaning cycle may comprise cleaning solution and water. Valve 108 may permit fluid from both water supply 106 and cleaning solution supply 104 to flow to nozzle 110. In some embodiments, a rinsing cycle may comprise only water. Valve 108 may block flow from cleaning solution supply 104 and only allow flow from water supply 106 to flow to nozzle 110.

In some embodiments, cleaning system 100 may comprise more than one nozzle. The multiple nozzles may all dispense cleaning solution, water, or steam at the same time depending on the cleaning cycle to create several streams of fluid 116 across the top of the sink basin. For example, during a rinsing cycle, all nozzles may dispense water only, during a cleaning cycle, all nozzles may dispense cleaning solution only, and during a steam-cleaning cycle, all nozzles may dispense steam only.

Alternatively, one or more nozzles may dispense only water, while one or more separate nozzles may dispense only cleaning solution. For example, during a rinsing cycle, only the nozzles connected to water supply 106 may dispense water; during a cleaning cycle, only the nozzles connected to cleaning solution supply 104 may dispense cleaning solution; and during a steam-cleaning cycle, only nozzles connected to water supply 106 may dispense steam. Further, a concentrated cleaning solution may be used and mixed with water upstream of nozzle 110. For example, cleaning solution from cleaning solution supply 104 and water from water supply 106 may each flow separately to valve 108. Cleaning solution from cleaning solution supply 104 may converge with water from water supply 106 at valve 108 and then mix and flow to nozzle 110. Nozzle 110 may dispense the mixture through opening 112 and onto an interior of a sink basin. For a rinse-only cycle, valve 108 may close off flow from cleaning solution supply 104 and only allow water from water supply 106 to flow to nozzle 110.

In some embodiments, cleaning solution supply 104 and water supply 106 may flow separately to separate nozzles. Each individual supply line may include an individual valve 108. For example, during a rinsing cycle, a valve controlling water supply 106 may open to allow water from water supply 106 to flow to nozzle 110, and a valve controlling cleaning solution supply 104 may close to restrict flow from cleaning solution supply 104 to nozzle 110. During a cleaning cycle, a valve controlling cleaning solution supply 104 may open to allow cleaning solution to flow form cleaning solution supply 104 to nozzle 110, and a valve controlling water supply 106 may close to restrict flow from water supply 106 to nozzle 110.

In some embodiments, water supply 106 is integrated into the plumbing system that supplies water to a faucet (not shown) of sink 102. Cleaning solution supply 104 may comprise a holding tank or reservoir. In some embodiments, a detector (not shown) may be used to detect a low supply of fluid. An indicator (not shown) may indicate to a user that the detector has detected a low cleaning solution level. For example, a level detector may detect when a level of the cleaning supply solution 104 is low, and indicate to a user that the level is low. In some embodiments, a detector may be a weight sensor, an optical sensor, an IR sensor, and/or any type of presence sensor.

Figure 2:
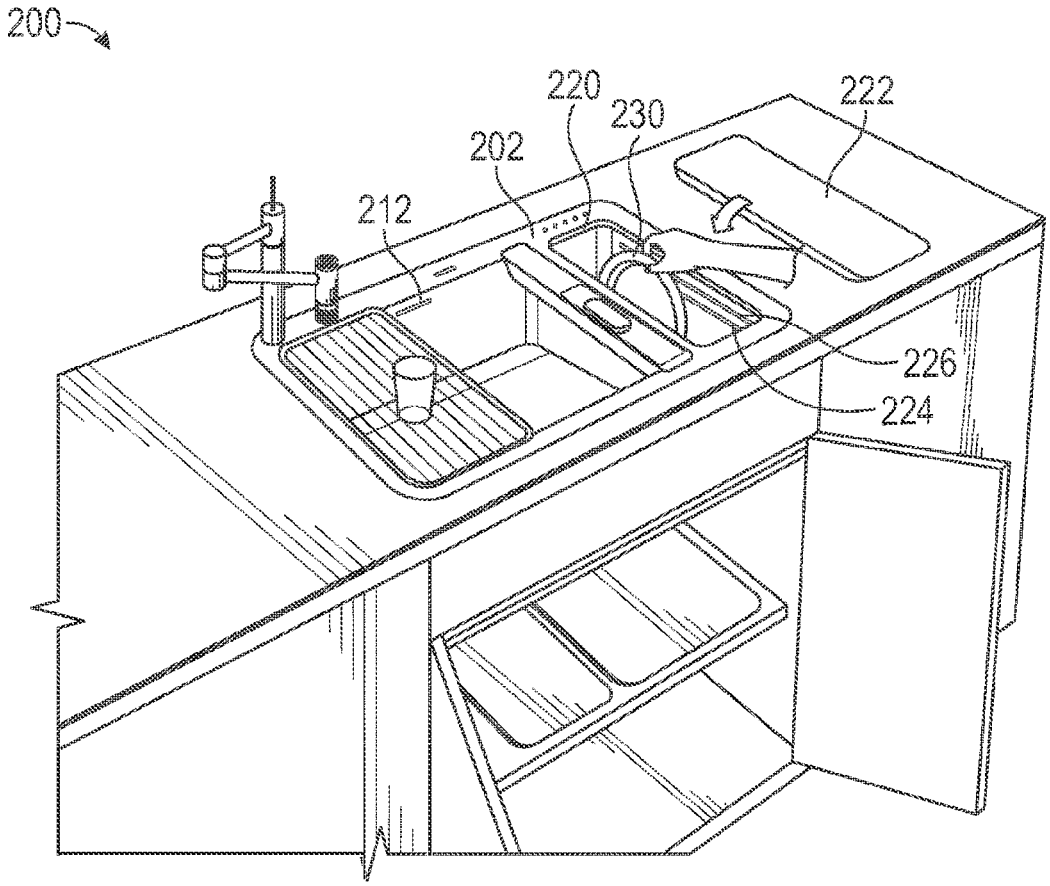
FIG. 2 shows a sink-cleaning system in accordance with some embodiments.

In some embodiments, cleaning system 100 may avow the lapse of a predetermined amount of time for cleaning fluid 116 to sit along the sides and floor of the sink basin and work to remove residue and bacteria from the sink basin surface. In some embodiments, a user may manually activate a water-only rinse cycle, without depending on a predetermined amount of time. In some embodiments, a user can control the predetermined amount of time. In some embodiments, a sink-cleaning system 100 may have various available cleaning cycles that comprise various predetermined amounts of time, such as a quick-clean cycle and a deep-clean cycle. Once the predetermined amount of time has passed, sink-cleaning system 100 may automatically activate a water-only rinse cycle to wash away the cleaning solution. FIG. 2 shows a cleaning system 200 comprising a sink-cleaning system and a dish-rinsing and dish-drying system. In some embodiments, a dish-rinsing and dish-drying system may be located in a sink basin separate from the sink basin comprising a sink-cleaning system. In some embodiments, a dish-rinsing and dish-drying system can be incorporated into the same sink basin as the sink-cleaning basin. A dish-rinsing and dish-drying system may be located in a second sink basin and include a sink-cleaning system in addition to the sink-cleaning system of a first sink basin.

One or more nozzles (not shown) may be located behind opening 212 and outside of a sink basin of sink 202. In some embodiments, one or more nozzles may be located within the housing of a sink basin, configured to dispense fluid through an opening 212 in a side wall of a sink basin of sink 202. In some embodiments, nozzles may be embedded into an interior surface of the side walls of a sink basin of sink 202, preempting the need for any openings at all. In some embodiments, the nozzles may be positioned such that fluid is dispensed from the nozzles, through opening 212, and to a surface of the interior of the sink basin. In some embodiments, nozzles may be configured to dispense fluid down a side wall proximate to a location of one or more nozzles. In some embodiments, one or more nozzles may be configured to dispense fluid through a single opening 212. In some embodiments, a single nozzle may be configured to dispense fluid through a single opening 212. In some embodiments, a single nozzle may be configured to dispense fluid 116 through one of several openings 212. In some embodiments, nozzles are configured to dispense fluid such that once the fluid has an opportunity to migrate down the side surfaces and to the floor of the sink basin, all interior surfaces of the sink basin of sink 202 are sufficiently covered by a thin layer of fluid. In some embodiments, nozzles may be configured to dispense fluid such that only a portion of the interior surfaces of the sink basin are covered by a thin layer of fluid.

As shown in FIG. 2, one or more openings 212 may be located near the top edge of a rear wall of the sink basin of sink 202. In some embodiments, opening 212 may be located on a side or a front of the sink basin of sink 202. In some embodiments, opening 212 may not be located along the top of a side wall of the sink basin of sink 202, but may instead be located somewhere within a middle of a side wall of the sink basin. In some embodiments, opening 212 may comprise a series of numerous openings, each corresponding to a different nozzle. In some embodiments, nozzles may be incorporated into the interior surface of the sides of the sink basin of sink 202, preempting the need for any openings at all.

In some embodiments, cleaning system 200 may comprise a dish-rinsing and dish-drying system. In some embodiments, a dish-cleaning and dish-drying system may be user activated. For example, once a user activates a water and/or air flow, the user can insert a dish 230 into the path of the water and/or air flow. According to FIG. 2, a water flow is dispensed from nozzles (not shown) and through opening 224. Air is dispensed through nozzles (not shown) and through opening 226.

As shown in FIG. 2, water and air may each be dispensed from different nozzles and through different openings (openings 224 and 226). For example, water may be dispensed from some nozzles and through opening 224, such that the stream of water flow is configured to travel in an substantially horizontal path across the sink basin. In addition, air may be dispensed from nozzles and through opening 226, such that the stream of air flow is configured to travel in an substantially horizontal direction.

In some embodiments, a cleaning cycle of the dish-cleaning system may be activated by a motion sensor or presence sensor such as an IR sensor or other optical sensor (not shown). For example, a user may position a dish 230 into a detection region of a sensor, and the dish-cleaning system may activate a rinsing cycle based on this detection input. In some embodiments, the dish-cleaning system may be configured such that a rinsing cycle lasts a predetermined amount of time and is automatically followed by a drying cycle that lasts a predetermined amount of time. In some embodiments, a rinsing or drying cycle may be activated by manual user input. For example, a user may press a button to activate a rinsing cycle that is computer programmed to last a predetermined amount of time. The user may then push a button to activate a drying cycle that is computer programmed to last a predetermined amount of time.

In some embodiments, a rinsing cycle and a drying cycle may activate simultaneously. As shown in FIG. 2, an air flow is dispensed through opening 226, which is located slightly above opening 224 along a side wall of the sink basin of sink 220, through which water is dispensed. Thus, if both a water flow and an air flow are activated at the same time, the two different fluids may be dispensed from different nozzles and flow through different openings. Thus, when a dish 230 that has been placed into sink 220 to be rinsed, it must pass through an air stream (or drying cycle) after passing through a water stream (rinsing cycle) as a user removes dish 230 from sink 220. Thus, the air stream of the drying cycle may remove water of the rinsing cycle from dish 230 as it is removed from the sink 220.

In some embodiments, the dish drying and rinsing system may dispense water and air at different times. Water may be dispensed through opening 224 first to rinse dish 230, and then air may be dispensed through opening 226 to dry dish 230. The drying cycle may activate automatically after the rinsing cycle according to a predetermined amount of time, automatically upon cessation of the rinsing cycle, or only upon user input.

In some embodiments, the air dispensed from opening 226 may serve as an air curtain to retain the rinsing water within the sink basin and prevent or minimize any water from splashing out of the sink basin of sink 220. In some embodiments, the dish-rinsing and dish-drying system may include a lid 222. In some embodiments, lid 222 may be fitted to cover the dish rinsing and drying basin during a steam-cleaning cycle, a sink-cleaning cycle, or it may be used to cover the dish rinsing and drying sink basin when not in use.

Figure 3:
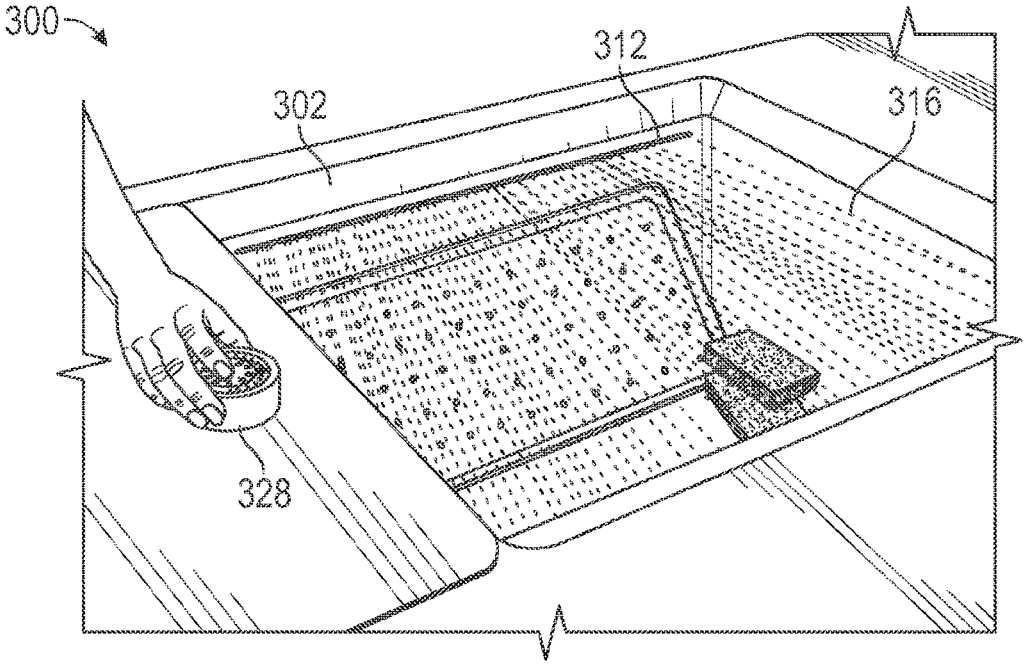
FIG. 3 shows a sink-cleaning system during a cleaning process in accordance with some embodiments.

FIG. 3 shows a cleaning system 300 during a sink-cleaning or sink-rinsing cycle. Nozzles (not shown) dispense fluid 316 through opening 312. The various streams of fluid 316 pass over the top of the sink basin of sink 302 in an substantially horizontal direction. However, the stream of fluid 316 may flow in any number of directions or pathways once dispensed from a nozzle. For example, in some embodiments, the stream of fluid 316 may be directed to the floor of the sink basin of sink 302, or may be directed in a diagonal towards a lower location on the front side of the sink basin. Further, in some embodiments, the nozzles may be positioned and configured to dispense fluid into an interior of a sink basin such that the dispensed fluid naturally flows towards a drain (not shown) in a floor of the sink basin of sink 302.

In some embodiments, cleaning system 300 may include a lid (not shown). The lid may be used to cover the sink basin during a cleaning cycle, during a steam cleaning cycle, or when the sink is not in use. In some embodiments, a cleaning cycle may automatically activate when the sink-cleaning system 300 detects the lid is in place on the sink basin. In some embodiments, a user may manually activate a cleaning cycle. In some embodiments, the cleaning system 300 may prevent the cleaning cycle from activating until a lid is detected in place on the sink basin, enclosing the sink basin. In some embodiments, a cleaning system 300 may detect and/or confirm the presence of a lid using mechanical engaging devices, magnetic engaging devices, optical signals, ultrasound signals, and/or capacitive signals.

In some embodiments, cleaning system 300 may include control 328. Control 328 may be any user input device and/or processor-based electronic device configured to receive inputs and to send control signals to one or more components of system 300. Control 328 may be included in both user-activated systems and in automatically-activated systems. For example, a user may enter an input to set a predetermined amount of time with control 328. The predetermined time may define how much time lapses between a cleaning cycle and a water-only rinsing cycle. In some embodiments, a user may activate a cleaning and/or rinsing cycle with control 328. In some embodiments, a user may use control 328 to indicate to the sink-cleaning system 300 that a lid is securely in place over the sink basin. A user may also use control 328 to define an amount of cleaning solution or a number of rinsing cycles, to select a quick-clean cycle or a deep-clean cycle, or even to control a temperature of the cleaning solution and/or water supply. In some embodiments, a user may use control 328 to define preferences correlating to various cleaning cycles. For example, a user may program a dispensing temperature of a fluid, a dispensing direction of one or more nozzles, a flow rate or amount of dispensing fluid, and a length of a cleaning cycle.

Figure 4:
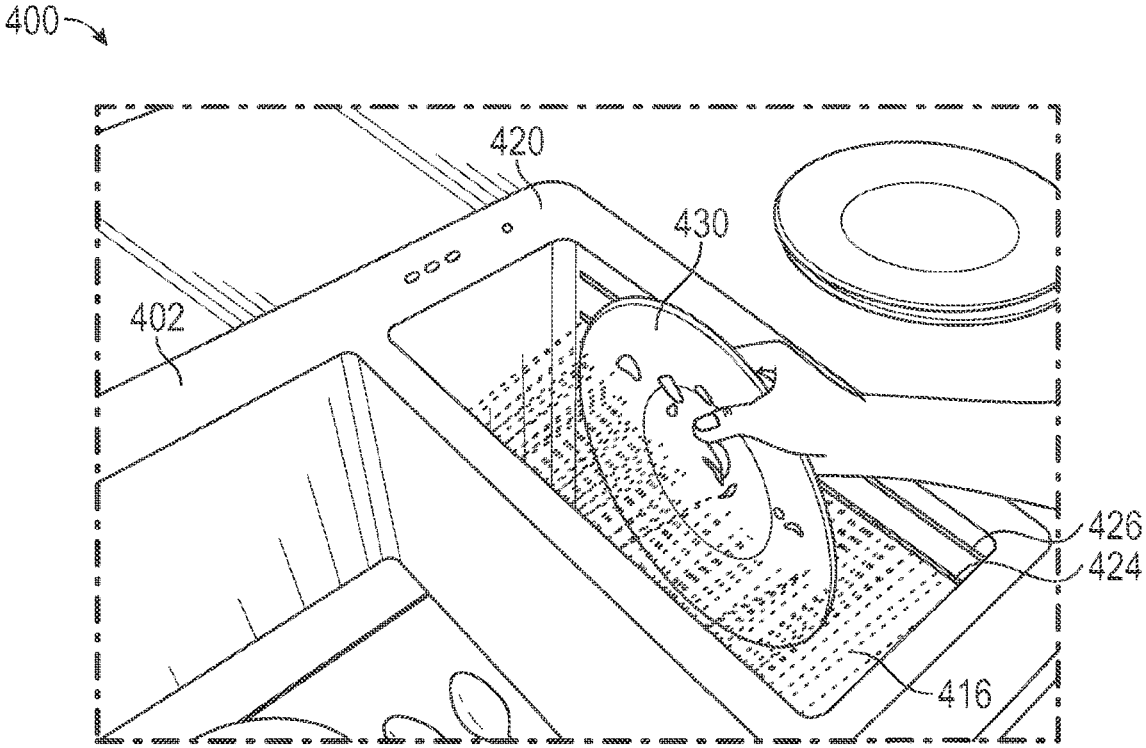
FIG. 4 shows a dish-rinsing component in accordance with some embodiments.

FIG. 4 shows a cleaning system 400 comprising a dish-rinsing and dish-drying system according to some embodiments. In FIG. 4, system 400 is located in a basin of sink 420. In some embodiments, a separate basin, a basin of sink 402, may comprise a sink-cleaning system. In some embodiments, a sink-cleaning system and a dish-rinsing and dish-drying system may be located in the same sink basin.

FIG. 4 shows the cleaning system 400 rinsing and drying dish 430, In some embodiments, system 400 may be used to rinse and dry food such as produce, or to rinse and dry other household items such as children's toys or pacifiers.

In some embodiments, the system 400 may have any combination of cleaning, rinsing, steam-cleaning, or drying capabilities. For example, some embodiments may comprise only a rinsing cycle, some embodiments may comprise only a steam-cleaning cycle, and some embodiments may comprise only cleaning and drying cycles.

In some embodiments, cleaning system 400 may comprise one or more nozzles (not shown) dedicated to dispensing only water and one or more nozzles (not shown) dedicated to dispensing only air. In some embodiments, all nozzles configured to dispense water may be located proximate to a single opening 424 such that during a rinsing cycle, water may be dispensed from one or more nozzles and through opening 424. In some embodiments, all nozzles configured to dispense air may be located proximate to a single opening 426 such that during a drying cycle, air may be dispensed from a nozzle and through opening 426. In some embodiments, water and air may both dispense through the same nozzles and through the same opening. In some embodiments, water and air may dispense from different nozzles, but through the same opening.

Figure 5:
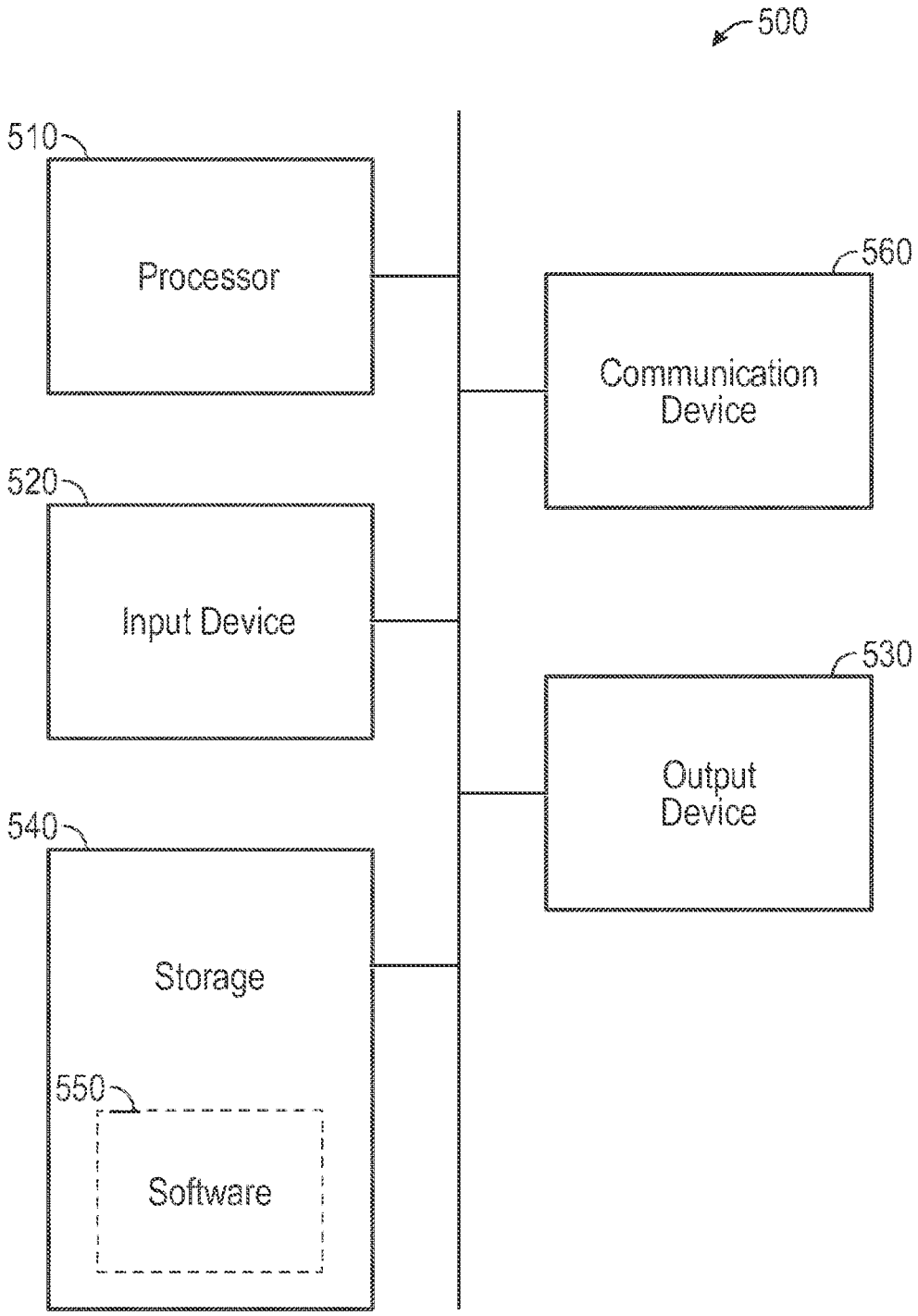
FIG. 5 shows a computer in accordance with some embodiments.

FIG. 5 shows a schematic illustration of computer 500, in accordance with some embodiments. Computer 500 can be a component of a fully or partially-automated sink system such as any of those described herein, such as any microprocessor-based controller included in any one or more of the components. In some embodiments, computer 500 is configured to execute a method for controlling one or more electronic components of a sink-cleaning system, dish-cleaning system, and/or dish-rinsing system, such as any of the systems discussed above. Computer 500 can be a host computer connected to a network. Computer 500 can be a client computer or a server. As shown in FIG. 5, computer 500 can be any suitable type of microprocessor-based device, such as a personal computer, workstation, server, or handheld computing device, such as a phone or tablet. The computer can include, for example, one or more of processor 510, input device 520, output device 530, storage 540, and communication device 560.

Input device 520 can be any suitable device that provides input, such as a touch screen or monitor, keyboard, mouse, or voice-recognition device. Output device 530 can be any suitable device that provides output, such as a touch screen, monitor, printer, disk drive, or speaker.

Storage 540 can be any suitable device that provides storage, such as an electrical, magnetic, or optical memory, including a RAM, cache, hard drive, CD-ROM drive, tape drive, or removable storage disk. Communication device 560 can include any suitable device capable of transmitting and receiving signals over a network, such as a network interface chip or card. The components of the computer can be connected in any suitable manner, such as via a physical bus or wirelessly. Storage 540 can be a non-transitory computer-readable storage medium comprising one or more programs, which, when executed by one or more processors, such as processor 510, cause the one or more processors to execute methods or techniques described herein, such as methods or techniques for automated control (e.g., execution of one or more cleaning or rinsing cycles) of any one or more of the systems and/or devices described herein. Software 550, which can be stored in storage 540 and executed by processor 510, can include, for example, the programming that embodies the functionality of the present disclosure (e.g., as embodied in the systems, computers, servers, and/or devices as described above). In some embodiments, software 550 can include a combination of servers such as application servers and database servers.

Software 550 can also be stored and/or transported within any computer-readable storage medium for use by or in connection with an instruction execution system, apparatus, or device, such as those described above, that can fetch and execute instructions associated with the software from the instruction execution system, apparatus, or device. In the context of this disclosure, a computer-readable storage medium can be any medium, such as storage 540, that can contain or store programming for use by or in connection with an instruction execution system, apparatus, or device.

Software 550 can also be propagated within any transport medium for use by or in connection with an instruction execution system, apparatus, or device, such as those described above, that can fetch and execute instructions associated with the software from the instruction execution system, apparatus, or device. In the context of this disclosure, a transport medium can be any medium that can communicate, propagate, or transport programming for use by or in connection with an instruction execution system, apparatus, or device. The transport-readable medium can include, but is not limited to, an electronic, magnetic, optical, electromagnetic, or infrared wired or wireless propagation medium.

Computer 500 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 500 can implement any operating system suitable for operating on the network. Software 550 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

Following are some embodiments of the invention.

Disclosed is an embodiment is a self-cleaning sink, comprising a sink basin comprising one or more walls; one or more nozzles disposed on one or more of the one or more walls of the sink basin, wherein the one or more nozzles are configured to be fluidly connected to a first fluid source and configured to dispense a first fluid from the first fluid source into an interior of the sink basin. In another embodiment, disclosed is a sink according to prior embodiment, wherein the first fluid comprises one or more of water, steam, and a cleaning solution. In another embodiment, disclosed is a sink according to the prior embodiments, wherein the one or more nozzles are configured to be fluidly connected to a second fluid source and to dispense a second fluid, different from the first fluid, into an interior of the sink basin.

In a further embodiment, disclosed is a sink according to the prior embodiments, wherein the second fluid comprises a cleaning solution and wherein the second fluid source is a cleaning solution container. In yet another embodiment, disclosed is a sink according to any of the prior embodiments, wherein the one or more nozzles comprise a first nozzle disposed on a first wall of the sink and a second nozzle disposed on a second wall of the sink, the second wall being opposite the first wall.

In a further embodiment, disclosed is a sink according to any of the prior embodiments, wherein the one or more nozzles are configured to dispense fluid substantially horizontally with sufficient pressure such that the fluid travels in an airborne stream across the sink basin. In another embodiment, disclosed is a sink according to any of the previous embodiments, wherein the one or more nozzles are disposed at an upper edge of the sink basin such that fluid dispensed onto a sink wall at a about a height of the one or more nozzles runs downward along the sink wall under gravity.

In another embodiment, disclosed is a sink according to any of the prior embodiments, further comprising a user input device configured to detect a user input and to responsively cause the one or more nozzles to dispense fluid. In a further embodiment, disclosed is a sink according to any of the previous embodiments, wherein the one or more nozzles are disposed in one or more insets in the wall of the sink such that they are configured to be hidden from view of a user of the sink. In other embodiments, disclosed is a sink according to any of the prior embodiments, further comprising a lid configured to enclose the sink basin.

Some other embodiments include the following.

In an embodiment, disclosed is a sink-cleaning method, comprising at a self-cleaning sink comprising a sink basin, one or more nozzles disposed on a wall of the sink basin and configured to dispense cleaning fluid into the sink basin, and one or more processors configured to send electronic signals to control operation of the one or more nozzles; determining, by the one or more processors, that a first predetermined criteria for initiating a cleaning cycle is met; in response to determining that the first criteria is met, sending an electronic signal from the one or more processors that causes the one or more nozzles to dispense cleaning fluid into the sink basin in accordance with the cleaning cycle; determining, by the one or more processors, that a second predetermined criteria for initiating a rinsing cycle is met; in response to determining that the second criteria is met, sending an electronic signal from the one or more processors that causes the one or more nozzles to dispense water into the sink basin in accordance with the rinsing cycle.

In another embodiment, disclosed is a method according to the prior embodiment, wherein the first criteria comprises detecting a user input entered to a user input device of the self-cleaning sink. In a further embodiment, disclosed is a method according to the prior embodiments, wherein the first criteria comprises determining that a time for a pre-scheduled cleaning cycle has arrived.

In another embodiment, disclosed is a method according to any of the prior embodiments, wherein the first criteria comprises determining that a user is not using the self-cleaning sink. In another embodiment, disclosed is a method according to any of the previous embodiments, wherein the first criteria comprises determining that a lid is attached to the self-cleaning sink.

In yet another embodiment, disclosed is a method according to any of the prior embodiments, wherein the second criteria comprises detecting a user input entered to a user input device of the self-cleaning sink. In a further embodiment, disclosed is a method of any of the previous embodiments, wherein the second criteria comprises determining that a cleaning cycle has been completed.

Some other embodiments of the invention include the following.

In an embodiment, disclosed is a dish-rinsing method, comprising at a basin comprising one or more nozzles disposed on a wall of the basin and configured to dispense cleaning fluid into the basin, and one or more processors configured to send electronic signals to control operation of the one or more nozzles; determining, by the one or more processors, that an item is present in the basin; in accordance with the determination that an item is present in the basin, sending an electronic signal from the one or more processors that causes the one or more nozzles to dispense fluid into the basin to rinse the item.

In a further embodiment, disclosed is a method according to the prior embodiment, wherein the basin further comprises one or more gas nozzles disposed on a wall of the basin and configured to dispense pressurized gas, wherein the method further comprises, in accordance with the determination that an item is present in the basin, sending an electronic signal from the one or more processors that causes the one or more gas nozzles to dispense pressurized gas into the basin to dry the item.

In another embodiment, disclosed is a method according to the prior embodiments, wherein the one or more gas nozzles are disposed above the one or more nozzles.

In a further embodiment, disclosed is a method according to any of the previous embodiments, comprising determining, by the one or more processors, that the item is no longer present in the basin; and in accordance with the determination that the item is no longer present in the basin, sending an electronic signal from the one or more processors that causes the one or more nozzles to cease dispensing fluid into the basin.

In another embodiment, disclosed is a method according to any of the previous embodiments, wherein determining that an item is present in the basin comprises receiving, from one or more optical sensors, an electronic signal indicating that the item is present in the basin.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A self-cleaning sink, comprising a sink basin comprising one or more walls;

a cleaning system comprising one or more nozzles disposed on one or more of the one or more walls; and a lid configured to enclose the sink basin, wherein the one or more nozzles are configured to be fluidly connected to a first fluid source and configured to dispense a first fluid from the first fluid source into an interior of the sink basin, the cleaning system is configured to determine the sink is not in use by detecting the lid is secured over a top of the sink, fully enclosing the sink basin, and the cleaning system is configured to activate a cleaning cycle manually via user input and automatically via a microprocessor-based controller.

2. The sink of claim 1, wherein the cleaning system comprises a microprocessor-based controller.

3. The sink of claim 2, wherein the microprocessor-based controller is configured to be connected to a network.

4. The sink of claim 1, wherein the cleaning system is configured to detect the sink basin is enclosed by the lid with one or more of a mechanical engaging device, a magnetic engaging device, an optical signal, an ultrasound signal, or a capacitive signal.

5. The sink of claim 1, wherein the cleaning system may be activated by user input.

6. The sink of claim 1, wherein the cleaning cycle comprises dispensing the first fluid into the sink basin interior.

7. The sink of claim 1, wherein the cleaning system is configured to prevent activation of the cleaning cycle if the sink basin is not enclosed by the lid.

8. The sink of claim 6, wherein the first fluid comprises one or more of water, steam, and a cleaning solution.

9. The sink of claim 1, wherein the cleaning system is configured to automatically activate the cleaning cycle upon detecting the sink basin is enclosed by the lid.

10. The sink of claim 6, wherein the one or more nozzles are configured to be fluidly connected to a second fluid source, and wherein the cleaning cycle comprises dispensing a second fluid, different from the first fluid, into the sink basin interior.

11. The sink of claim 1, wherein a nozzle dispensing angle, a duration of the cleaning cycle, a first fluid flow rate, a first fluid temperature, or an amount of first fluid dispensed are configured to be manually and automatically controlled.

12. The sink of claim 1, wherein the one or more nozzles are configured to dispense the first fluid into the sink basin interior such that substantially all surfaces of the sink basin interior are covered with a thin layer of the first fluid.

13. The sink of claim 1, wherein first fluid comprises one or more of water, steam, and a cleaning solution.

14. The sink of claim 1, wherein the cleaning cycle comprises dispensing a cleaning solution onto the sink basin interior.

15. The sink of claim 14, wherein the cleaning cycle comprises allowing the cleaning solution to sit on the sink basin interior for a predetermined amount of time.

16. The sink of claim 15, wherein, upon completion of the predetermined amount of time, the cleaning cycle comprises dispensing water onto the interior surface of the sink basin to wash away the cleaning solution.

17. The sink of claim 1, wherein the cleaning cycle comprises dispensing a cleaning solution onto the sink basin interior, followed by a rinsing cycle comprising dispensing water onto the sink basin interior.

18. The sink of claim 1, configured to automatically activate a steam-cleaning cycle upon detecting the sink basin is enclosed by the lid.

19. The sink of claim 17, wherein the cleaning cycle comprises dispensing steam onto the sink basin interior.

20. The sink of claim 1, wherein the cleaning system is configured to perform a drying cycle wherein air is dispensed from the one or more nozzles.

* * * * *